US007422456B1

(12) United States Patent
Mitani et al.

(10) Patent No.: US 7,422,456 B1
(45) Date of Patent: Sep. 9, 2008

(54) COAXIAL CONNECTOR

(75) Inventors: Ikujiro Mitani, Tokyo (JP); Teruo Katayama, Tokyo (JP); Takeshi Nobe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/076,584

(22) Filed: Mar. 20, 2008

(30) Foreign Application Priority Data

Apr. 10, 2007 (JP) ..... 2007-102781

(51) Int. Cl.
*H01R 13/64* (2006.01)

(52) U.S. Cl. ..... 439/248; 439/247

(58) Field of Classification Search ..... 439/246–248
See application file for complete search history.

(56) References Cited

U.S. PATENT DOCUMENTS 4,580,862 A * 4/1986 Johnson ..... 439/238
4,697,859 A * 10/1987 Fisher, Jr. ..... 439/246
5,516,303 A 5/1996 Yohn

FOREIGN PATENT DOCUMENTS

JP 2000-228256 8/2000
JP 2001-057268 2/2001
JP 2003-123914 4/2003
JP 2007-087682 4/2007

* cited by examiner

*Primary Examiner*—Tho D Ta
(74) *Attorney, Agent, or Firm*—Kubotera & Associates, LLC

(57) ABSTRACT

A coaxial connector to be connected to a mating connector includes a fixed assembly body and a movable assembly body connected to the fixed assembly body along an axial direction. The fixed assembly body includes a fixed side inner conductive body; a holding member for holding the movable assembly body; a fixed side insulation member for insulating between the fixed side inner conductive body and the holding member; and a first urging member for using the movable assembly body. The movable assembly body includes a movable side inner conductive body; a movable side outer conductive body; and a movable side insulation member. The movable side inner conductive body includes a first relay terminal having a retaining portion, a second relay terminal having a contact portion retained in the retaining portion, and a second urging member for urging the second relay terminal toward the fixed side inner conductive body.

9 Claims, 4 Drawing Sheets

COAXIAL CONNECTOR

The present invention relates to a coaxial connector. More specifically, the present invention relates to a coaxial connector having a floating mechanism.

A coaxial connector can be attached to an object such as a panel, a board, or the like when used. The coaxial connector includes an inner conductive body and an outer conductive body. When the coaxial connector fits with a mating connector, it is necessary to appropriately fit the inner conductive body to the outer conductive body.

For example, when two coaxial connectors are fitted into each other, and then are fixed to a board, a displacement can occur between the coaxial connectors in an axial direction (fitting and separation direction) thereof or a radial direction that is perpendicular to the axial direction. Accordingly, the connectors often cannot be connected appropriately due to the displacement. Such a displacement needs to be corrected in order to connect the coaxial connectors to each other appropriately upon fitting.

For example, patent Reference has disclosed a coaxial connector that can be fitted and separated while correcting a displacement in an axial direction and a radial direction thereof. The coaxial connector has a flange portion in which a screw aperture is provided for attaching to a panel. A gap is provided between an inner diameter of the screw aperture and an outer diameter of a fixation screw of the flange portion in order to constitute a floating mechanism in the radial direction. Further, a coil spring provided inside the outer conductive body constitutes a floating mechanism in the axial direction.

Patent Reference Japanese Patent Publication No. 2003-123914

In the conventional coaxial connector described above, a displacement in the axial direction and the radial direction can be corrected. However, when the coaxial connector is floated in the axial direction thereof, the connector as a whole is displaced against a panel in the axial direction (enters inside of the panel). Accordingly, it is necessary to provide a space to allow the displacement inside of the panel.

Further, the inner conductive body cannot be directly connected to the board due to the displacement. Accordingly, it is necessary to substantively attach the inner conductive body on an end portion of the cable. Further, a gap is provided to enable the coaxial connector to be floated in the radial direction. Accordingly, it is necessary to have a flange that is large enough to allow the gap, thereby increasing a size of the connector as a whole.

In view of the problems described above, an object of the present invention is to provide a coaxial connector in which a displacement in an axial direction and a radial direction thereof can be corrected when fitting with the mating connector. Further, an object of the present invention is to provide a small coaxial connector.

Further objects and advantages of the invention will be apparent from the following description of the invention.

SUMMARY OF THE INVENTION

In order to attain the objects described above, according to the present invention, a coaxial connector includes a fixed assembly body to be fixed to an object; and a movable assembly body connected to the fixed assembly body along an axial direction thereof. The movable assembly body is arranged to be movable in the axial direction to fit to and separate from the mating connector and a radial direction perpendicular to the axial direction.

The fixed assembly body includes a fixed side inner conductive body; a holding member; a fixed side insulation member; and a first urging member. The holding member is attached to the object for holding the movable assembly body to be movable in the axial direction and the radial direction. The fixed side insulation member insulates between the fixed side inner conductive body and the holding member. The first urging member urges the movable assembly body that is held by the holding member toward the mating connector.

The movable assembly body includes a movable side inner conductive body; a movable side outer conductive body; and a movable side insulation member. The movable side insulation member insulates the movable side inner conductive body and the movable side outer conductive body.

The movable side inner conductive body includes a first relay terminal; a second relay terminal; and a second urging member. The second relay terminal is electrically connected to the first relay terminal. Further, the second relay terminal has a contact portion retained in the retaining portion of the first relay terminal to contact with the fixed side inner conductive body. The second urging member urges the second relay terminal toward the fixed side inner conductive body.

In the coaxial connector described above, the fixed side inner conductive body may include a sliding surface, so that the contact portion of the second relay terminal slides against the sliding surface. The sliding surface may have a first radius in the radial direction larger than a sum of a second radius of the contact portion in the radial direction and a movable amount of the movable assembly body in the radial direction.

In the coaxial connector described above, the second urging member may be formed of a first coil spring disposed along an inner surface of the retaining portion of the first relay terminal. The second relay terminal may include a protruding portion retained in the first coil spring; a first flange portion for receiving an urging force of the first coil spring; and a main body portion having the contact portion.

In the coaxial connector described above, the first relay terminal may be arranged such that the inner surface of the retaining portion contacts with an outer surface of the main body portion of the second relay terminal to electrically connect the first relay terminal to the second relay terminal.

In the coaxial connector described above, the movable side outer conductive body may include an outer shell member; an inner shell member; and a third urging member. The outer shell member fits in the mating connector. The inner shell member is arranged to contact with the first urging member and attached to the outer shell member. The third urging member urges the outer shell member away from the inner shell member in the axial direction.

In the coaxial connector described above, the third urging member may be formed of a second coil spring. The outer shell member may include a second flange portion for receiving an urging force of the second coil spring. The inner shell member may include a third flange portion for receiving the urging force of the second coil spring.

In the coaxial connector described above, the first urging member may be formed of a leaf spring. The holding member may include a fixed side holding member for holding the leaf spring.

In the coaxial connector described above, the first relay terminal further may include a first engagement protruding portion for engaging the movable side insulation member. The fixed side inner conductive body may include a second engagement protruding portion for engaging the fixed side insulation member.

In the coaxial connector described above, the holding member may include a fourth flange portion to be placed on the object. The fourth flange portion has a hole for inserting a fixing screw to be fixed to the object.

DETAILED DESCRIPTION OF THE PREFERRED EMBODIMENTS

Hereunder, embodiments of the present invention will be explained with reference to the accompanying drawings.

First Embodiment

A first embodiment of the present invention will be explained.

Figure 1:
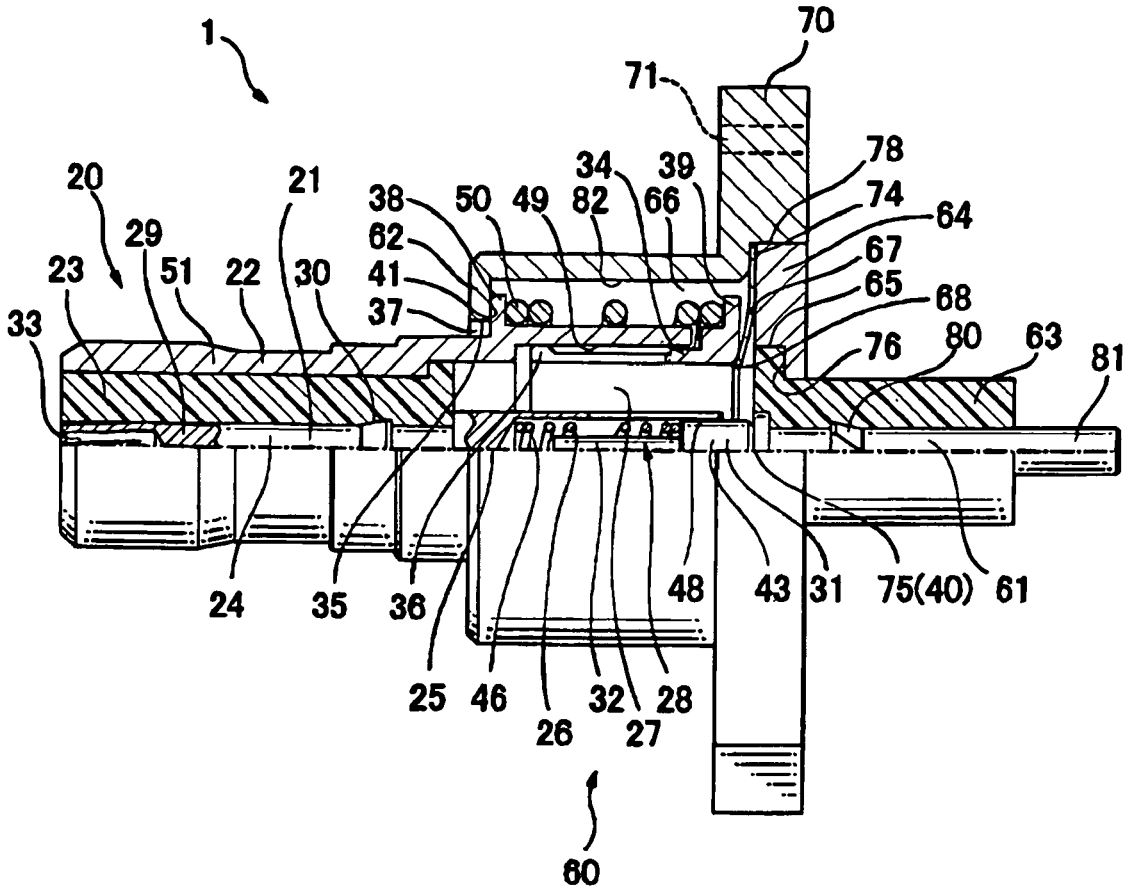
FIG. 1 is a partial sectional view showing a coaxial connector according to a first embodiment of the present invention.
Figure 2:
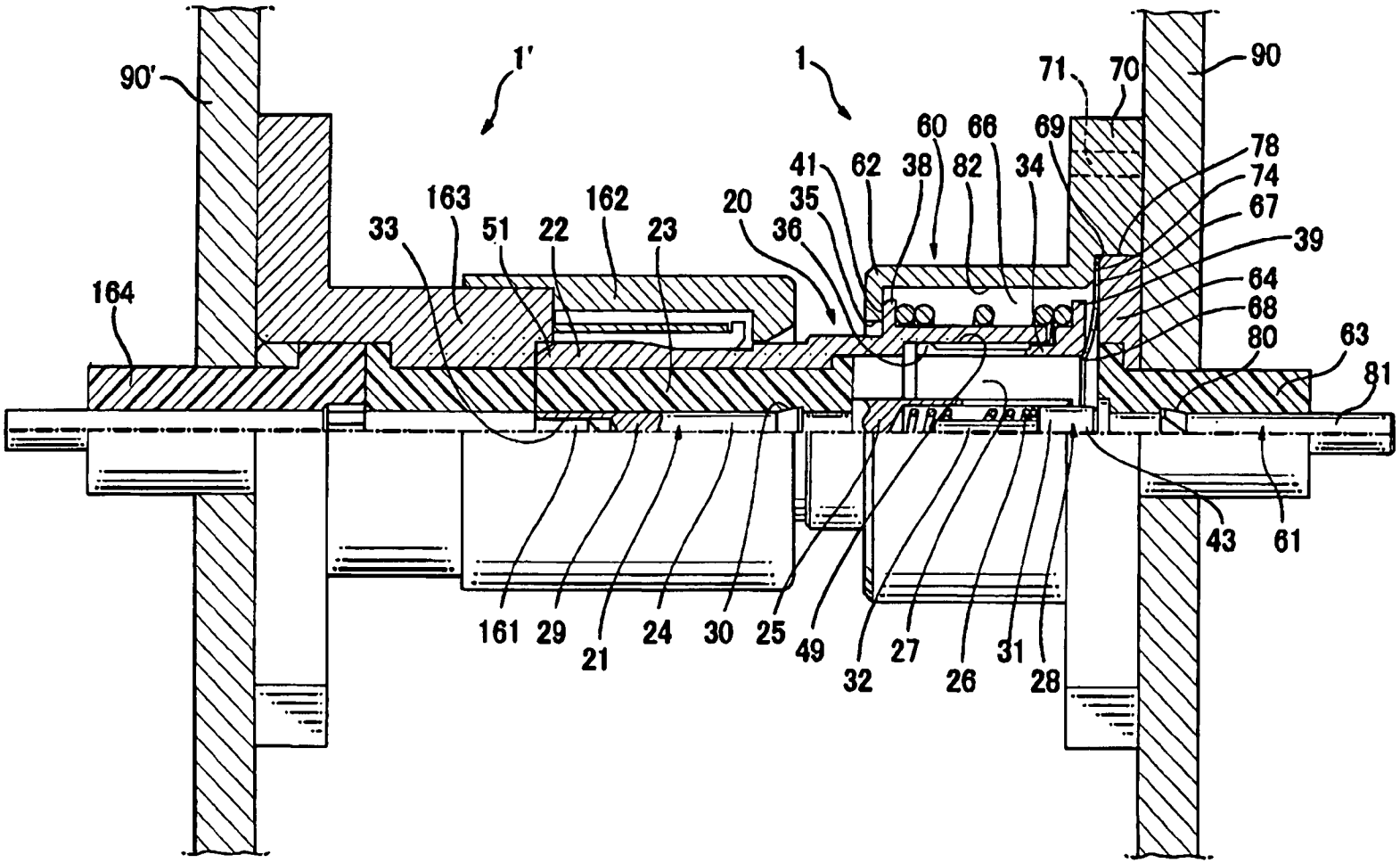
FIG. 2 is a partial sectional view showing the coaxial connector in a state that the coaxial connector is connected to a mating connector according to the first embodiment of the present invention.
Figure 3:
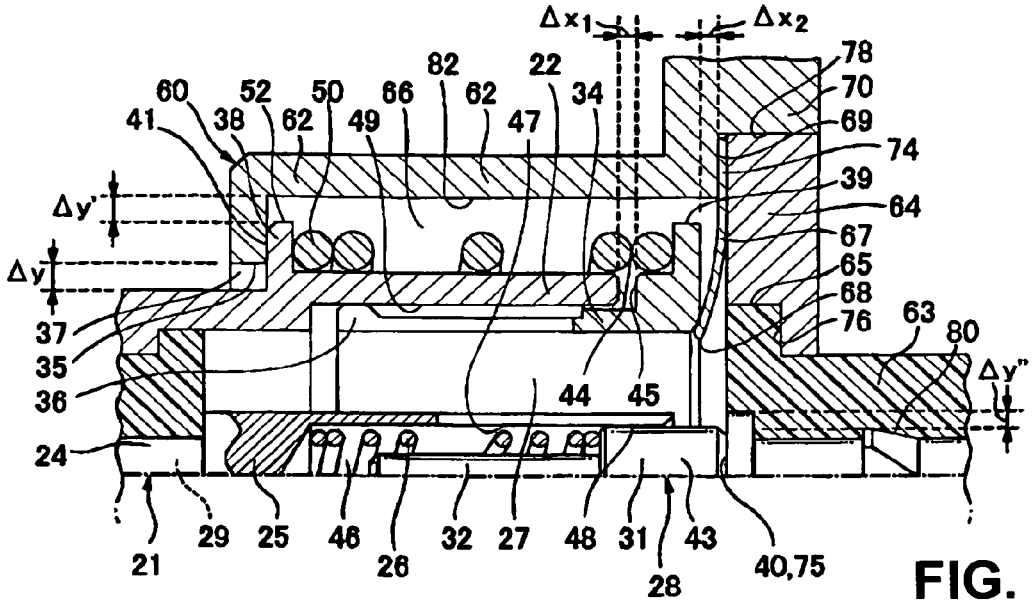
FIG. 3 is a partial enlarged view of the coaxial connector shown in FIG. 1 according to the first embodiment of the present invention.
Figure 4:
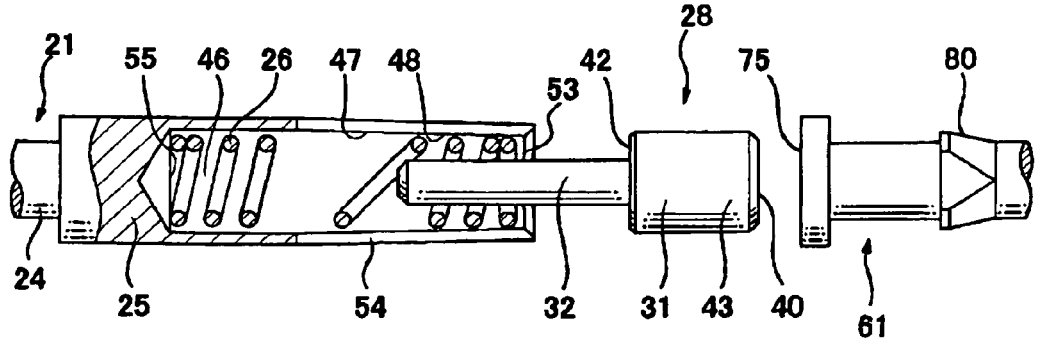
FIG. 4 is another partial enlarged view of the coaxial connector shown in FIG. 1 according to the first embodiment of the present invention.

FIG. 1 is a partial sectional view showing a coaxial connector 1 according to the first embodiment of the present invention. FIG. 2 is a partial sectional view showing the coaxial connector 1 in a state that the coaxial connector 1 is connected to a mating connector 1' according to the first embodiment of the present invention. FIG. 3 is a partial enlarged view of the coaxial connector 1 shown in FIG. 1 according to the first embodiment of the present invention. FIG. 4 is another partial enlarged view of the coaxial connector 1 shown in FIG. 1 according to the first embodiment of the present invention.

In the embodiment of the present invention, the coaxial connector 1 mainly comprises a movable assembly body 20 and a fixed assembly body 60. As shown in FIG. 2, the coaxial connector 1 can be fixed to an object such as a board 90, a panel, or the like through the fixed assembly body 60 when used.

The mating connector 1' can be fitted into and separated from the coaxial connector 1. The mating connector 1' can be a conventional connector. The mating connector 1' comprises, for example, an inner conductive body 161; outer conductive bodies 162 and 163; and an insulation member 164. The insulation member 164 is arranged between the inner conductive body 161 and the outer conductive bodies 162 and 163.

Similar to the coaxial connector 1 of the present invention, the mating connector 1' can be fixed to an object such as the board 90, a panel, and the like when used. The mating connector 1' does not necessarily have to be the conventional connector. Instead, the mating connector 1' can be the coaxial connector 1 according to the embodiment of the present invention.

In the embodiment, the movable assembly body 20 is movable relative to the fixed assembly body 60. More specifically, the movable assembly body 20 is attached to the fixed assembly body 60, so that the movable assembly body 20 is movable in an axial direction in which the mating connector 1' is fitted into and separated from the connector 1 and a radial direction perpendicular to the axial direction.

That is, the coaxial connector 1 has a floating mechanism. Accordingly, for example, when the coaxial connector 1 that is fixed to the board 90 and the mating connector 1' that is fixed to a board 90' are fitted with each other, the coaxial connector 1 and the mating connector 1' can be connected smoothly.

In the embodiment, the coaxial connector 1 and the mating connector 1' can be connected smoothly even though the coaxial connector 1 and the mating connector 1' or the boards fixed thereto are displaced with each other while allowing such a displacement. Because of the configuration described above, the fixed assembly body 60 and the board 90 do not have to be connected through a flexible member such as a cable (not shown) as conventionally done.

In the embodiment, the movable assembly body 20 includes a movable side inner conductive body 29; a movable side outer conductive body 51; and a movable side insulation member 23. The movable side inner conductive body 29 is made of metal. The movable side outer conductive body 51 having an approximate tubular shape is made of metal and is arranged to surround the movable side inner conductive body 29.

In the embodiment, the movable side insulation member 23 made of a resin is arranged between the movable side inner conductive body 29 and the movable side outer conductive body 51 on a fitting and separation side of the movable side inner conductive body 29. Further, the movable side insulation member 23 electrically insulates the movable side inner conductive body 29 and the movable side outer conductive body 51.

In the embodiment, the movable side outer conductive body 51 includes a movable side outer conductive body (outer shell member) 22; an inner shell member 34; and an urging member 50 (third urging member). The movable side outer conductive body (outer shell member) 22 extends from a fitting and separation side to a board attachment side.

The inner shell member 34 is mounted to be slidable inside of a board attachment side of the movable side outer conductive body 22. The urging member 50 (third urging member) is arranged to surround outside of the board attachment side of the movable side outer conductive body 22 and is, for example, formed of a coil spring.

In the embodiment, a board attachment side of the movable side outer conductive body 22 is retained in a receptacle space 66 that is formed inside of a fixed side outer conductive body 62. On the other hand, a fitting and separation side of the movable side outer conductive body 22 is exposed outside through a hole 35 of the fixed side outer conductive body 62. The movable side outer conductive body 22 fits with the mating connector 1' on the fitting and separation side that is exposed outside.

In the embodiment, a flange portion 38 is provided on a fitting and separation side of the movable side outer conductive body 22, so that the movable assembly body 20 does not come off from the hole 35 of the fixed side outer conductive body 62 and the movable assembly body 20 is movable in a radial direction thereof. A radius of the flange portion 38 is larger than that of the hole 35.

In the embodiment, a flange portion 39 is provided on a board attachment side of the inner shell member 34 in a position facing the flange portion 38. A fitting and separation side of the inner shell member 34 is provided inside of the movable side outer conductive body 22. Further, a circular protruding portion 36 provided on a distal of the inner shell member 34 slides an inner wall 49 of the movable side outer conductive body 22 in the axial direction.

In the embodiment, the urging member 50 is provided between the flange portion 38 of the movable side outer conductive body 22 and the flange portion 39 of the inner shell member 34. The urging member 50 urges the movable side outer conductive body 22 and the inner shell member 34 to separate in an axial direction.

As shown in FIG. 3, a gap "Δx1" in the axial direction is formed between an edge 44 of the movable side outer conductive body 22 and an upper step portion 45 of the flange portion 39 due to the urging member 50. The gap "Δx1" enables the inner shell member 34 to float against the movable side outer conductive body 22. Further, the gap "Δx1" enables the movable assembly body 20 to float more and stronger against the fixed assembly body 60 than in the case in which a gap "Δx2" is provided through a circular leaf spring 67 (described below).

That is, the movable assembly body 20 can float against the fixed assembly body 60 for a distance of the "Δx1+Δx2".

The "Δx1+Δx2" includes the gap "Δx1" that can be formed through the urging member 50 in addition to the gap "Δx2" that can be formed through the circular leaf spring 67.

As a result, for example, when the coaxial connector 1 and the mating connector 1' are fitted with each other, the connector 1 and the mating connector 1' can be connected with each other even though a position of the connector 1 is displaced in the axial direction or the radial direction while absorbing such a displacement with these gaps.

In the embodiment, the urging member 50 is provided in addition to the circular leaf spring 67. Accordingly, the urging member 50 increases an amount of floating in the axial direction. Further, the flange portion 39 and the circular leaf spring 67 can contact more stably. Since the urging member 50 is arranged to surround outside of the board attachment side of the movable side outer conductive body 22, the coaxial connector 1 is not enlarged in length in the axial direction thereof.

In the embodiment, the movable side inner conductive body 29 comprises a movable side center conductive body (first relay terminal) 21; a movable side contact conductive body (second relay terminal) 28; and an urging member (second urging member) 26.

The movable side center conductive body (first relay terminal) 21 made of metal is provided on the fitting and separation side. The movable side contact conductive body (second relay terminal) 28 formed of metal is provided on the board attachment side while connected with the movable side center conductive body 21. The urging member (second urging member) 26 formed of metal urges the movable side center conductive body 21 and the movable side contact conductive body 28 in a direction to be separated.

In the embodiment, the movable side center conductive body 21 is connected with the central conductive body 161 (shown in FIG. 2) of the mating connector 1'. The movable side contact conductive body 28 is electrically connected with the fixed side inner conductive body 61 of the fixed assembly body 60. Accordingly, the movable side center conductive body 21 and the movable side contact conductive body 28 are connected. Further, the central conductive body 161 of the mating connector 1' and a fixed side inner conductive body 61 of the connector 1 are electrically connected.

In the embodiment, the movable side center conductive body 21 comprises a small diameter pillar portion 24 on the fitting and separation side, and a large diameter pillar portion 25 on the board attachment side. A grooved recess 33 is provided on a distal of the small diameter pillar portion 24.

A specific portion of the center conductive body 161 of the mating connector 1' is inserted into the grooved recess 33. Further, the movable side center conductive body 21 can engage with the movable side insulation member 23 through an engagement protruding portion 30 provided near a middle portion of the small diameter pillar portion 24.

In the embodiment, the large diameter pillar portion 25 is provided with four slits 54 from an approximate middle position to an opening 53 on the board attachment side. The four slits 54 are cut in an equal interval. Further, a retaining portion 46 is formed, so that the movable side contact conductive body 28 can be retained inside through the opening 53.

The slits 54 are provided, so that an inside diameter of the retaining portion 46 is slightly held toward the opening 53. Accordingly, the movable side contact conductive body 28 can be held with a specific strength near the opening 53. The urging member 26 is provided in the retaining portion 46, so that one end portion is contacted with an inner wall surface 55 of the retaining portion 46 and the other end portion is contacted with a specific position of the movable side contact conductive body 28.

With the urging member 26, the movable side contact conductive body 28 can be held to be slidable against the fixed side inner conductive body 61. The urging member 26 can be, for example, formed of a coil spring arranged along the inner wall 47 of the retaining portion 46 of the movable side center conductive body 21.

As shown in FIG. 4, the movable side contact conductive body 28 comprises a protruding portion 32 and a body portion 31 (shown in an exploded view in FIG. 4 for easier understanding). The protruding portion 32 on the fitting and separation side can be completely retained in the retaining portion 46 and the urging member 26 that is provided inside the retaining portion 46.

In the embodiment, an outer surface 43 of the body portion 31 is held by a near insertion slot inner edge 48 of the retaining portion 46 while protruding from the retaining portion 46 to some extent. The body portion 31 is provided on the board attachment side in such a way as to connect the protruding portion 32. The outer surface 43 of the body portion 31 of the movable side contact conductive body 28 is in contact with an inner wall 47 of the retaining portion 46 of the movable side center conductive body 21.

Accordingly, the movable side center conductive body 21 and the movable side contact conductive body 28 can be electrically contacted. Further, a flange portion 42 is provided on the fitting and separation side of the movable side contact conductive body 28.

In the embodiment, the flange portion 42 receives an urging force of the urging member 26. Accordingly, the flange portion 42 is constantly urged in the axial direction from the fitting and separation side toward the board attachment side or the fixed side inner conductive body 61. As a result, for example, when the coaxial connector 1 and the mating connector 1' are fitted with each other, even though a position of the connector 1 is displaced toward an axial direction or a radial direction, the urging member 26 can display a flexible effect to absorb such a displacement.

At the same time, the movable side contact conductive body 28 can always contact a sliding surface 75 of the fixed side inner conductive body 61 in the contact portion 40. The sliding surface 75 is flat.

In view of a gap created especially in the radial direction, a radius of the sliding surface 75 in the radial direction is sized to be larger than a sum of a radius of the contact portion 40 in the radial direction and a movable amount of the movable assembly body 20 in the radial direction so that the contact portion 40 can contact the sliding surface 75 more securely.

That is, as shown in FIG. 3 in detail, a "Ay'''" is sized to be larger than a "Ay" or a "Ay'''". The "Ay'''" is a distance that the contact portion 40 can move in the radial direction on the sliding surface 75. The "Ay" is a size of the gap 37 in the radial direction. The "Ay'''" is as large as the "Ay" and is sized to be larger than a distance between a side face 52 of the flange portion 38 and an inner wall 82 of the fixed side outer conductive body 62 in the radial direction.

In the embodiment, the fixed assembly body 60 includes the fixed side inner conductive body 61; the fixed side outer conductive body (fixed holding member) 62; a fixed side insulation member 63; and the circular leaf spring (first urging member) 67. The fixed side inner conductive body 61 is made of metal. The fixed side outer conductive body (fixed holding member) 62 made of metal is provided around the fixed side inner conductive body 61.

The fixed side insulation member 63 made of a resin is arranged between the fixed side inner conductive body 61 and the fixed side outer conductive body 62 and electrically insulates the fixed side inner conductive body 61 and the fixed side outer conductive body 62. Further, the circular leaf spring (first urging member) 67 made of metal urges the movable assembly body 20 that is held by the fixed side outer conductive body 62 toward the mating connector 1'.

In the embodiment, the fixed side inner conductive body 61 along with the fixed side insulation member 63 is provided to pierce the board 90. The fixed side inner conductive body 61 can be electrically connected with the movable side inner conductive body 29 of the movable assembly body 20. Further, the fixed side inner conductive body 61 can be electrically connected with the central conductive body 161 (shown in FIG. 2) of the mating connector 1' through the movable assembly body 20.

In the embodiment, the sliding surface 75 (shown in FIG. 4) that is flat is provided on the fitting and separation side of the fixed side inner conductive body 61. The sliding surface 75 can contact a specific portion (contact portion 40) of the movable assembly body 20 to be slidable.

In the embodiment, an exposed portion 81 is provided on the board attachment side in order to solder with a specific portion of the board. The exposed portion 81 is exposed from the fixed side insulation member 63.

Further, an engagement protruding portion 80 is provided near a middle portion of the exposed portion 81 and the sliding surface 75. The engagement protruding portion 80 engages with the fixed side insulation member 63. The engagement protruding portion 80 is pressed fit to the fixed side insulation member 63 to be fixed to the fixed side insulation member 63.

In the embodiment, the fixed side outer conductive body 62 forms an outermost shell of the fixed assembly body 60, and is used to hold the movable assembly body 20 to be movable. The fixed side outer conductive body 62 is electrically connected with the movable side outer conductive body 51 of the movable assembly body 20. Further, the fixed side outer conductive body 62 is electrically connected with the outer conductive bodies 162 and 163 of the mating connector 1' through the movable assembly body 20.

In the embodiment, a large diameter flange portion 70 is provided on the board attachment side of the fixed side outer conductive body 62, and is useful to mount the fixed assembly body 60 to the board 90. The fixed assembly body 60 can be fixed to the board 90 through inserting a fixation screw (not shown) into an aperture 71 provided in an appropriate position. Further, a small diameter flange portion 69 is provided inside of the large diameter flange portion 70 to hold the circular leaf spring 67 along with the holding member 64.

The fitting and separation side of the fixed side outer conductive body 62 forms the receptacle space 66. The receptacle space 66 extends toward a side facing the fixed side inner conductive body 61. Further, the receptacle space 66 can hold the board attachment side of the movable side outer conductive body 51 inside.

In the embodiment, the fitting and separation side of the movable side outer conductive body 51 is retained in the receptacle space 66. Further, the fitting and separation side of the movable side outer conductive body 51 is exposed outside through the hole 35 of fixed side outer conductive body 62. The fixed side outer conductive body 62 can be electrically connected with the mating connector 1' through a contact with, for example, the movable side outer conductive body 51.

A radius of the hole 35 is sized to be larger than that of the movable side outer conductive body 51 of the movable assembly body 20 so that the movable assembly body 20 is movable in the radial direction. As a result, for example, the gap 37 having a size of the Δy (shown in FIG. 3) is formed between the movable assembly body 20 and the hole 35 in a radial direction. The circular leaf spring 67 is arranged on the board attachment side of the fixed side outer conductive body 62.

Figure 5:
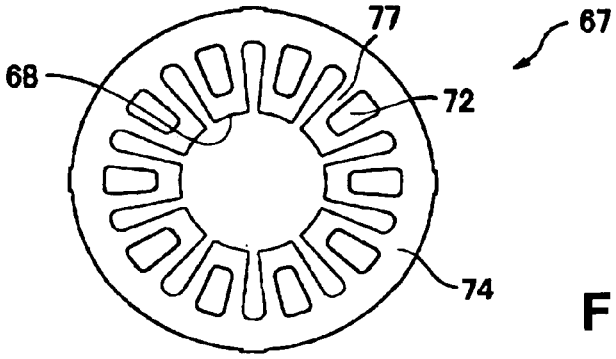
FIG. 5 is a plan view showing a circular leaf spring of the coaxial connector according to the first embodiment of the present invention.

FIG. 5 is a plan view showing the circular leaf spring 67 according to the first embodiment of the present invention. As shown in FIG. 5, the circular leaf spring 67 has a circular upper face. A plurality of the leaf spring portions 77 having a specific shape is provided in the circular leaf spring 67. The leaf spring portions 77 are formed of cutting a radial direction of the circular leaf spring 67 and providing a hole 72 in a center of each circular leaf spring 67 that is cut to separate from other leaf spring portions 77.

In the embodiment, distal ends 68 of the leaf spring portions 77 are bent upwardly to be flexible. The circular leaf spring 67 is fitted into the small diameter flange portion 69 of the fixed side outer conductive body 62. At this time, each distal end 68 of the bending side that can be flexible faces the fitting and separation side.

As a result, near each distal end 68 of the leaf spring portion 77 contacts with a specific portion (inner shell member 34) of the movable assembly body 20 and displays force to urge the movable assembly body 20 from the board attachment side to the fitting and separation side. As a result, a gap having a size of "Δx2" can be formed (shown in FIG. 3). The distal end 68 of the leaf spring portion 77 is provided in every direction. Accordingly, the distal end 68 can display urging force in every direction.

A holding member 64 is used to hold the fixed side insulation member 63 in the fixed side outer conductive body 62. The holding member 64 is a relatively thick metal member having an approximate circular shape. The holding member 64 is fitted into the fixed side outer conductive body 62. At this time, near a peripheral portion 74 of the circular leaf spring 67 is held between a fitting and separation side surface of the holding member 64 and the small diameter flange portion 69 of the fixed side outer conductive body 62.

Further, an inner diameter step portion 76 provided in an inner radial side is used to cover a flange portion 65 of the fixed side insulation member 63 from the board attachment side to the fitting and separation side.

Accordingly, the fixed side insulation member 63 is prevented from coming off from the fixed side outer conductive body 62.

In the embodiment, the holding member 64 is made of metal; and thereby electrically connected with the movable assembly body 20 through the circular leaf spring 67. Further, the holding member 64 can be electrically connected with the large diameter flange portion 70 through directly contacting with the large diameter flange portion 70 on a side face 78. It should be noted that the fixed side insulation member 63 is held between the holding member 64 and the fixed side inner conductive body 61. Accordingly, the holding member 64 and the fixed side inner conductive body 61 are insulated.

Second Embodiment

Figure 6:
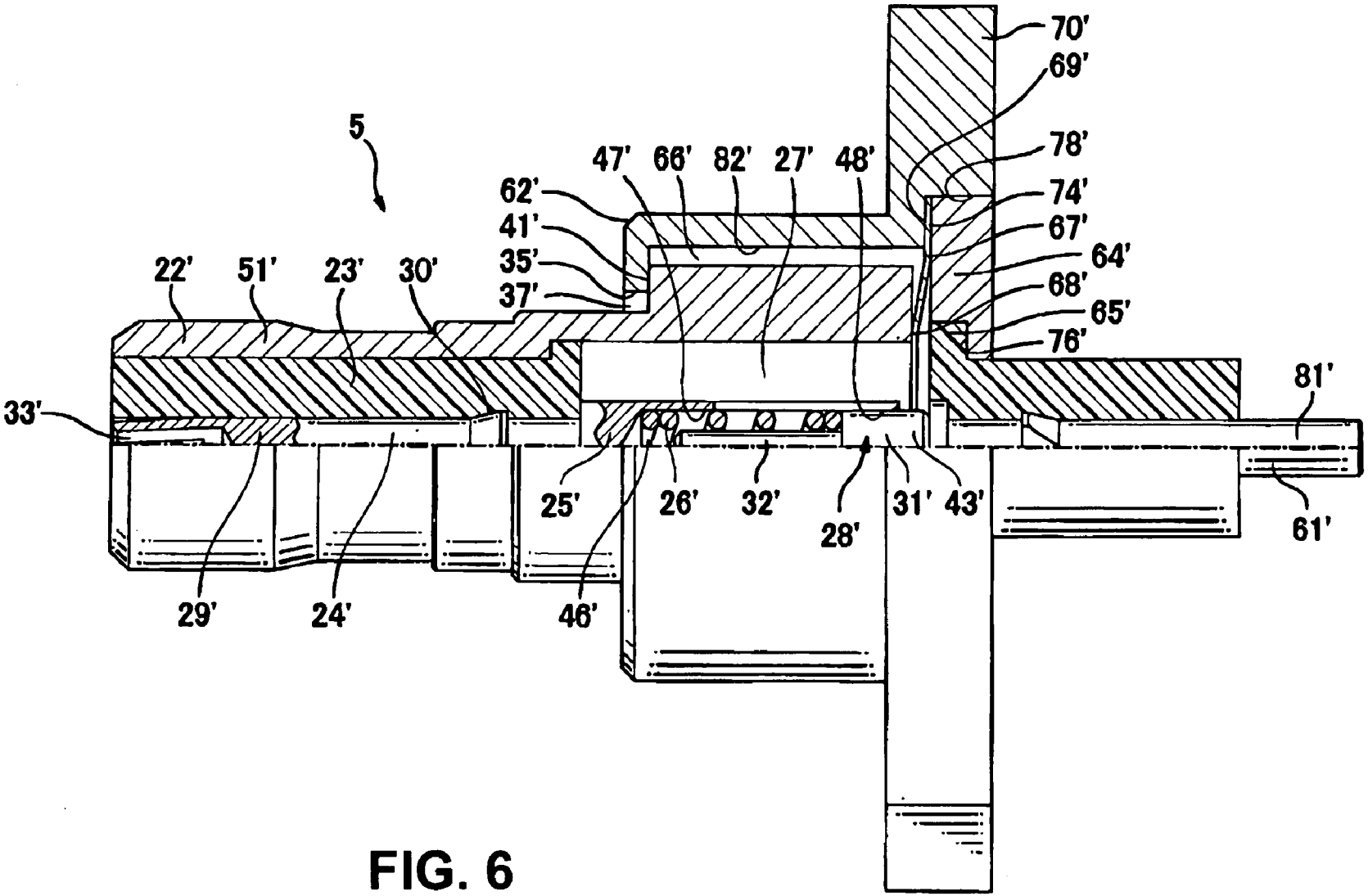
FIG. 6 is a partial sectional view showing a coaxial connector according to a second embodiment of the present invention.

A second embodiment of the present invention will be explained next. FIG. 6 is a partial sectional view showing a coaxial connector 5 according to the second embodiment of the present invention.

Different from the coaxial connector 1 shown in FIG. 1 in the first embodiment, the coaxial connector 5 absorbs a displacement in an axial direction or a radial direction thereof through only the circular leaf spring 67. Accordingly, different from the first embodiment shown in FIG. 1, the inner shell member 34, the flange portion 38, and an equivalent member of the urging member 50 and the like are not provided here.

In the embodiment, the flange portion 38 is provided to correspond to the flange portion 39 of the inner shell member 34. The urging member 50 is provided between the flange portions 38 and 39.

As shown in FIG. 6, the number of parts can be limited and the cost can be reduced, even though smaller spring force can be obtained compared with the case in which the urging member 50 is used. In FIG. 6, the same reference numbers are assigned to the members similar to the members in FIG. 1 in the first embodiment.

The coaxial connector of the present invention can be specifically applied in a situation, for example, in which a displacement is created between the connectors. Such situation can occur when the coaxial connector is connected using the board. In addition, the coaxial connector of the present invention can be applied to a normal connection without using the board.

The disclosure of Japanese Patent Application No. 2007-102781, filed on Apr. 10, 2007 is incorporated in the application by reference.

While the invention has been explained with reference to the specific embodiments of the invention, the explanation is illustrative and the invention is limited only by the appended claims.

What is claimed is:

1. A coaxial connector to be connected to a mating connector, comprising:

a fixed assembly body to be fixed to an object; and a movable assembly body connected to the fixed assembly body along an axial direction thereof, said movable assembly body being arranged to movable in the axial direction and a radial direction perpendicular to the axial direction, wherein said fixed assembly body includes:

a fixed side inner conductive body;

a holding member attached to the object for holding the movable assembly body to be movable in the axial direction and the radial direction;

a fixed side insulation member for insulating between the fixed side inner conductive body and the holding member; and a first urging member for urging the movable assembly body toward the mating connector, and said movable assembly body includes:

a movable side inner conductive body, said movable side inner conductive body including a first relay terminal having a retaining portion, a second relay terminal electrically connected to the first relay terminal and having a contact portion retained in the retaining portion to contact with the fixed side inner conductive body, and a second urging member for urging the second relay terminal toward the fixed side inner conductive body;

a movable side outer conductive body; and a movable side insulation member for insulation the movable side inner conductive body and the movable side outer conductive body.

2. The coaxial connector according to claim 1, wherein said fixed side inner conductive body includes a sliding surface so that the contact portion slides against the sliding surface, said sliding surface having a first radius in the radial direction larger than a sum of a second radius of the contact portion in the radial direction and a movable amount of the movable assembly body in the radial direction.

3. The coaxial connector according to claim 1, wherein said second urging member is formed of a first coil spring disposed along an inner surface of the retaining portion, said second relay terminal including a protruding portion retained in the first coil spring, a first flange portion for receiving an urging force of the first coil spring, and a main body portion having the contact portion.

4. The coaxial connector according to claim 1, wherein said first relay terminal is arranged so that the inner surface of the retaining portion contacts with an outer surface of the main body portion to electrically connect the first relay terminal to the second relay terminal.

5. The coaxial connector according to claim 1, wherein said movable side outer conductive body includes an outer shell member to fit in the mating connector, an inner shell member arranged to contact with the first urging member and attached to the outer shell member, and a third urging member for urging the outer shell member away from the inner shell member in the axial direction.

6. The coaxial connector according to claim 5, wherein said third urging member is formed of a second coil spring, said outer shell member including a second flange portion for receiving an urging force of the second coil spring, said inner shell member including a third flange portion for receiving the urging force of the second coil spring.

7. The coaxial connector according to claim 1, wherein said first urging member is formed of a leaf spring, said holding member including a fixed side holding member for holding the leaf spring.

8. The coaxial connector according to claim 1, wherein said first relay terminal further includes a first engagement protruding portion for engaging the movable side insulation member, and said fixed side inner conductive body includes a second engagement protruding portion for engaging the fixed side insulation member.

9. The coaxial connector according to claim 1, wherein holding member includes a fourth flange portion to be placed on the object, said fourth flange portion having a hole for inserting a fixing screw to be fixed to the object.

* * * * *